United States Patent [19]

Ramirez

[11] 4,199,078

[45] Apr. 22, 1980

[54] TOILET TISSUE STORAGE CONTAINER

[76] Inventor: Edward Ramirez, 2604 Jupe, San Antonio, Tex. 78222

[21] Appl. No.: 916,905

[22] Filed: Jun. 19, 1978

[51] Int. Cl.[2] ..... A47K 10/38

[52] U.S. Cl. ..... 221/309; 211/49 D; 220/4 E; 242/55.3; 312/45

[58] Field of Search ..... 312/39, 41, 45, 72, 312/73, 43, 42, 49; D6/97; 242/55.53, 55.3; 211/49 D; 225/39, 42, 44, 46; 220/4 B, 4 E, DIG. 25; 221/307, 308, 309

[56] References Cited

U.S. PATENT DOCUMENTS

| | | | |
|---|---|---|---|
| 1,106,218 | 8/1914 | Homburg | 221/309 |
| 2,689,062 | 9/1954 | Brown | 221/307 |
| 2,871,078 | 1/1959 | Carleo | 312/39 |
| 2,904,274 | 9/1959 | Hicks | 242/55.3 |

FOREIGN PATENT DOCUMENTS

| | | | |
|---|---|---|---|
| 552396 | 12/1956 | Italy | 221/307 |

OTHER PUBLICATIONS

"Container"—by Foytlin et al., I.B.M. Technical Disclosure Bulletin, vol. 5, No. 1, p. 8, Jun. 1962.

*Primary Examiner*—Alexander Grosz

[57] ABSTRACT

The toilet tissue storage container has two wide flexible tabs protruding downwards and angled inwards, one on the front wall and one on the rear wall. The strength and flexibility of the tabs is developed by the width, length, thickness and angle. The strength and flexibility enable the tabs to hold the weight of four rolls of tissue and expand outwards allowing a full or new roll of tissue to be withdrawn in its entirety. The protruding of the tabs from their respective walls is made possible by the narrow grooves on each side of each tab.

1 Claim, 1 Drawing Figure

TOILET TISSUE STORAGE CONTAINER

Figure 1:
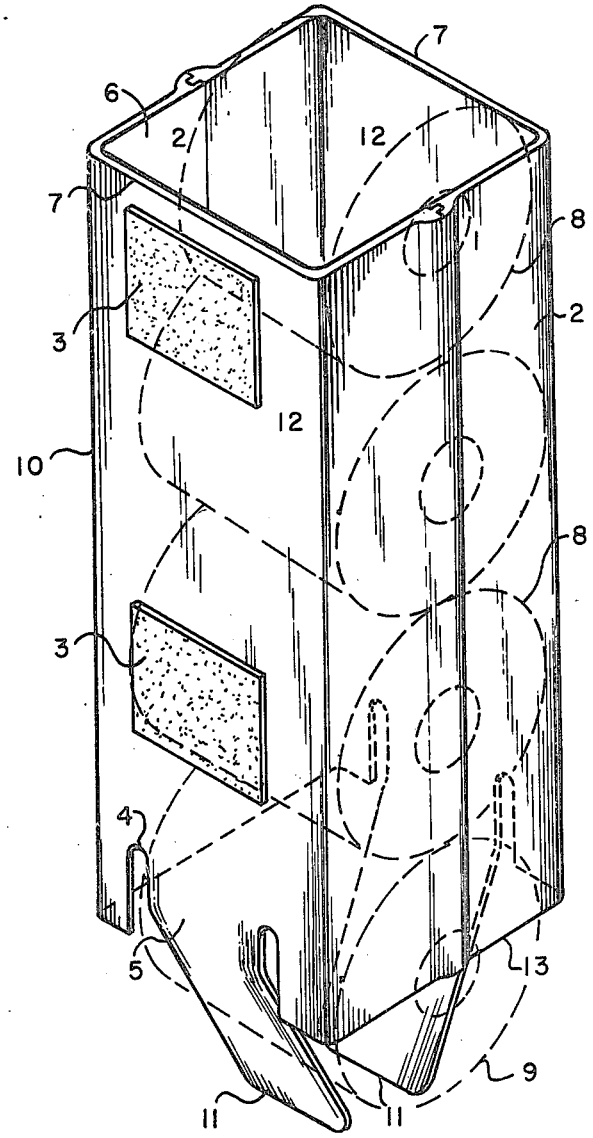

The main object of this invention is to provide a toilet tissue storage container for home use, lightweight, and moulded of hi-impact styrene plastic or equivelent; that stores four rolls of toilet tissue close to the existing tissue holder.

Another main object of this invention is to provide a design of a tissue container that can be mass produced using plastic injection moulding process.

Still another main object of this invention is to provide the minimum of tooling for the mould used in the injection moulding process.

Another object of this invention is to have a tissue container that is adaptable, suitable, attractive in the bathroom and will eliminate embarrassing situations occuring frequently in the home when the tissue holder is without paper.

Prior art and current commercially available devices incorporate a storage area and roll holder or dispenser that makes them bulky and not adaptable or suitable for home use.

The fact is that the majority of homes and apartments being built incorporate a tissue holder either made of ceramic or the regular wooden type.

It stands to reason that prior art in this field of endeavor has not provided a tissue storage container that is adaptable, suitable, attractive, practical and fulfills the needs of the homeowner.

The invention will be more clearly understood by referring to the following description and the accompanying drawing.

FIG. 1 is a perspective view of the toilet tissue storage container embodying the features of the invention.

The invention consists of a rectangular tube formed by interlocking two identical halves made by plastic injection moulding process. This together with other objects and advantages will make the invention readily understood.

Referring to the drawing in detail, the tissue storage container 10, is built of two identical halves 7, locked together, and bonded, using one of several processes to bond plastic. Sidewalls 2 are formed when the halves 7 are locked together. Moulded in the halves 7 which form the container 10, are two tabs 11 that have a certain length, width, thickness and extend inwards and downwards at bend 5 of 30 degrees from the front wall 12 and rear wall 12.

The length of groove 4 makes it possible to form bend 5 of tabs 11 at any pre-determined distance from edge 13 on front wall 12 and rear wall 12. The distance from bend 5 of tabs 11 from edge 13 determines the amount of exposed tissue 9.

Four rolls of toilet tissue 8 and 9 are inserted horizontally through the top opening 6. Tissue 9 is positioned and available for removal by grasping both ends of toilet tissue 9, which is partly exposed, with one hand and pulling downwards, causing tabs 11 to expand outwards and releasing roll 9, making the following top roll 8 available for removal. The width of groove 4 and the curvature at the top end of groove 4 prevents the plastic from breaking as the tabs 11 expand.

The four roll toilet tissue container 10 is easily installed on the bathroom wall by the use of two squares 3 of double coated urethane foam tape.

The toilet tissue container 10 can store rolls of tissue in a horizontal position in sizes from 4 inches diameter to 5 inches diameter, with the standard length of 4½ inches.

Having described the invention and shown the drawing of the toilet tissue storage container, what I claim as new is:

1. A wall mountable toilet tissue storage container adapted to hold a plurality of stacked toilet tissue rolls, said container comprising two identical injection molded plastic halves interlocked with each other along two longitudinal sides to form an elongated tube having an open top, said plastic halves having at their lower end a flexible tab bent inwardly between five and thirty degrees, and a longitudinal narrow groove on each side of the resilient tab, whereby the lower end of the container permits the removal of a toilet tissue roll from the plurality of stacked rolls.

* * * * *